US007199757B2

(12) United States Patent
Tung

(10) Patent No.: US 7,199,757 B2
(45) Date of Patent: Apr. 3, 2007

(54) ANTENNA ASSEMBLY AND A WIRELESS TELECOMMUNICATION APPARATUS USING THE SAME

(75) Inventor: Hao-Chun Tung, Chinmen Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 11/128,921

(22) Filed: May 13, 2005

(65) Prior Publication Data

US 2005/0253761 A1 Nov. 17, 2005

(30) Foreign Application Priority Data

May 14, 2004 (TW) ..... 93113601 A

(51) Int. Cl.
*H01Q 1/38* (2006.01)
*H01Q 1/24* (2006.01)
*H01Q 1/36* (2006.01)

(52) U.S. Cl. ..... 343/700 MS; 343/702; 343/895

(58) Field of Classification Search ..... 343/700 MS, 343/702, 895
See application file for complete search history.

(56) References Cited

U.S. PATENT DOCUMENTS 6,016,128 A * 1/2000 Imamura et al. ..... 343/741
6,693,604 B2 * 2/2004 Washiro et al. ..... 343/895
6,741,214 B1 * 5/2004 Kadambi et al. .... 343/700 MS
6,819,287 B2 * 11/2004 Sullivan et al. ..... 343/700 MS
2002/0030626 A1 * 3/2002 Nagumo et al. ..... 343/700 MS
2002/0140610 A1 * 10/2002 Onaka et al. ..... 343/700 MS
2002/0145569 A1 * 10/2002 Onaka et al. ..... 343/702
2002/0149521 A1 * 10/2002 Hendler et al. ..... 343/700 MS

* cited by examiner

*Primary Examiner*—Trinh Vo Dinh
(74) *Attorney, Agent, or Firm*—Ladas and Parry LLP

(57) ABSTRACT

An antenna assembly includes a base board defining a grounding and dielectric domains, a ground metal layer fabricated on the grounding domain, a dielectric medium mounted on the dielectric domain, and having an upper surface and one lateral surface, a first metal strip including a wave-like strip section mounted on the upper surface of the dielectric medium, and a lateral strip section mounted on the lateral surface of the dielectric medium, and a second metal strip fabricated on the lateral surface of the dielectric medium and having a coupling end coupled electrically to the ground metal layer. After assembly, the first and second metal strips and the ground metal layer cooperatively form an oscillator by virtue of electromagnetic induction to posses a specific frequency range.

20 Claims, 4 Drawing Sheets

ANTENNA ASSEMBLY AND A WIRELESS TELECOMMUNICATION APPARATUS USING THE SAME

FIELD OF THE INVENTION

The present invention relates to an antenna assembly, more particularly to a built-in antenna assembly for a wireless telecommunication apparatus, such as a cellular-phone handset.

BACKGROUND OF THE INVENTION

Due to rapid innovation in the electronic communication technology, dual-band or triple-band mobile cellular phones are available in the market, lately. For a businessman who travels a lot, a mobile phone with dual-band capability is preferred since the mobile phone can switch frequencies once required. In other words, it can operate in dual bands (such as 800-MHz and 1900-MHz). Most users prefer a compact mobile phone to a bulky-size one since the former has high reliability in the signal transmitting and receiving ability. In order to achieve high reliability in the transmitting and receiving signals, the quality and functionality of the antenna assembly play a major role in the mobile phone. It is therefore the prime object of the manufacture to improve the functionality of the quality of the antenna assembly in the cellular-phone handset.

FIG. 1 shows a conventional built-in single frequency band antenna assembly used in a mobile phone, is inverted F-shaped, and includes a radiating metal plate 10, a ground metal layer 12, a feeding leg 14 and an open-end connecting leg 16, wherein an etching operation is carried out to extend the feeding leg 14 through an opening 18 in the ground metal layer 12 in order to couple with the radiating metal plate 10. The feeding leg 14 and the ground metal layer 12 are not connected to each other in order to avoid a short circuit problem.

The aforesaid conventional antenna assembly is generally fabricated in the mobile phone such that the latter possesses a fashion design as far as the external appearance is concerned when compared to those mobile phones having externally-mounted antenna assemblies. The built-in antenna assembly requires lesser assembling steps, thereby shortening the production time of the mobile phone. However, the built-in antenna assembly is said to suffer from insufficient of communication band and impedance matching phenomenon, which, in turn, results in difficulties during the designing process of the built-in antenna assembly.

SUMMARY OF THE INVENTION

The object of the present invention is to provide a built-in antenna assembly for use in a mobile phone, the antenna assembly has a unique structure to provide dual-band capability and a compact size.

Another object of the present invention is to provide a built-in antenna assembly which has impedance matching ability to enhance the freedom of matching impedance of the mobile phone.

In one aspect of the present invention, a built-in antenna assembly is provided for use in a mobile phone. The antenna assembly accordingly includes: a base board defining a grounding domain and a dielectric domain; a ground metal layer fabricated on the grounding domain in the base board; a dielectric medium, being a perspective structure, mounted on the dielectric domain in the base board and having an upper surface and at least one lateral surface; a first metal strip including a wave-like strip section mounted on the upper surface of the dielectric medium and having a feed-in end, and a lateral strip section mounted on the lateral surface of the dielectric medium and having a first open end; and a second metal strip fabricated on the lateral surface of the dielectric medium and having a coupling end coupled electrically to the ground metal layer and a second open end. After assembly, the first and second metal strips and the ground metal layer cooperatively form an oscillator by virtue of electromagnetic induction to possess a specific frequency range, thereby permitting transmitting and receiving data signals under multi frequencies within the specific frequency range. The second metal strip is adapted to adjust impedance matching of the antenna assembly.

In another aspect of the present invention, a mobile phone is provided to include: a base board defining a grounding domain and a dielectric domain; a signal processing circuit fabricated on the base board for processing wireless signals; and an antenna assembly. The antenna assembly includes: a dielectric medium, being a perspective structure, mounted on the dielectric domain in the base board and having an upper surface and at least one lateral surface, a first metal strip including a wave-like strip section mounted on the upper surface of the dielectric medium and having a feed-in end coupled electrically to the signal processing circuit for transmitting and receiving the wireless signals, and a second metal strip fabricated on the lateral surface of the dielectric medium, and having a coupling end coupled electrically to the ground metal layer. After assembly, the first and second metal strips and the ground metal layer cooperatively form an oscillator by virtue of electromagnetic induction to have a specific frequency range, thereby permitting transmitting and receiving wireless signals under multi frequencies within the specific frequency range.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1:
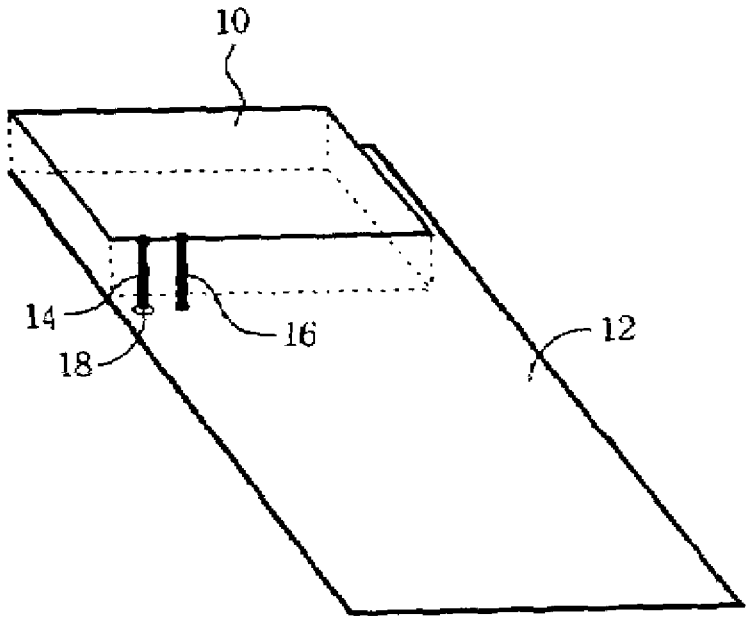
Fig. 1 (Prior Art)
FIG. 1 is a perspective view of an inverted F-shaped conventional antenna assembly used in a wireless telecommunication apparatus.
Figure 2:
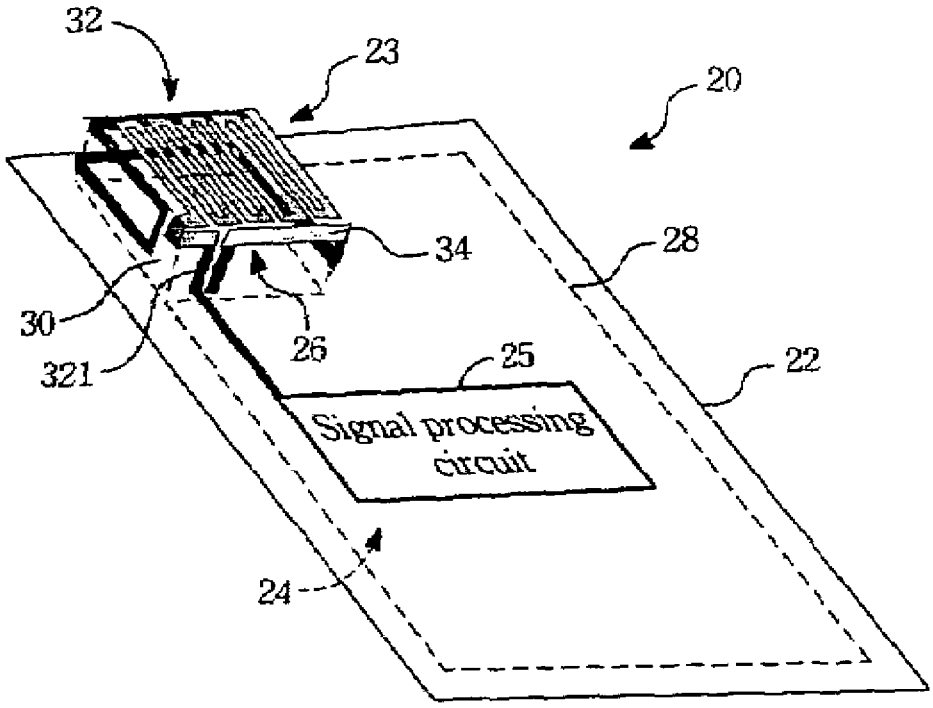
FIG. 2 is a perspective view of an antenna assembly according to the present invention for use in a wireless telecommunication apparatus, such as a mobile phone.

Referring to FIG. 2, a perspective view of the preferred embodiment of a wireless telecommunication apparatus (such as a mobile phone) according to the present invention is shown to include an outer casing (not shown), a base board 22, a signal processing circuit 25, and an antenna assembly 23.

As illustrated, the base board 22, preferably a printed circuit board, is disposed stationarily and securely within the outer casing (not shown), and has an upper surface defining a dielectric domain 26 and a lower surface opposite to the upper surface and defining a grounding domain 24. The signal processing circuit 25 is fabricated on the upper surface of the base board 22 for processing outgoing and incoming wireless signals, which are received or transmitted through the antenna assembly 23. The antenna assembly 23 has a feeding end 321 coupled electrically to the signal processing circuit 25 so as to permit transmitting and receiving of the processed signals. A detailed structure of the antenna assembly 23 is described in the following paragraph.

Figure 3A:
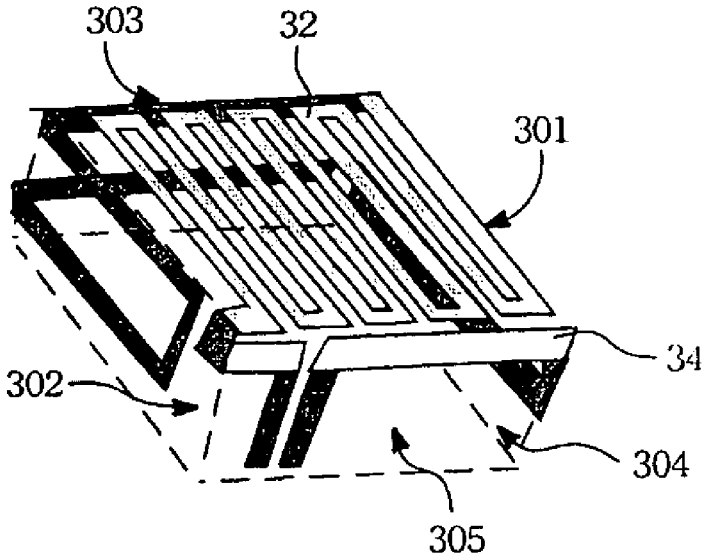
FIG. 3A shows a fragmentary portion of the antenna assembly shown in FIG. 2.
Figure 3B:
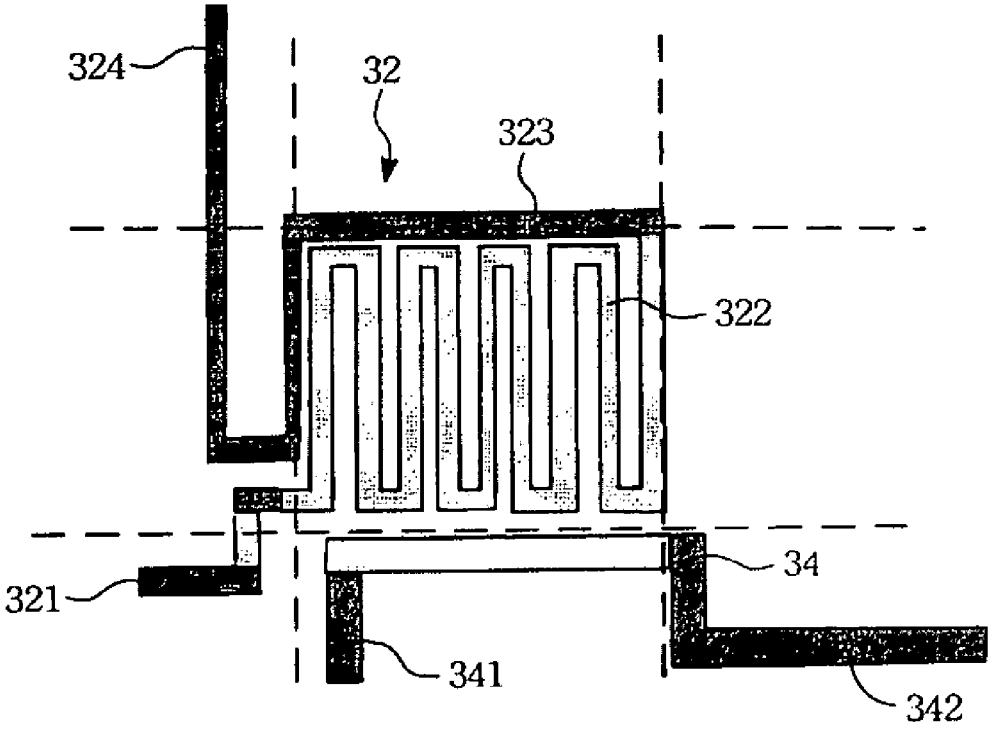
FIG. 3B shows a spread-out view of the antenna assembly of the present invention when viewed from above.

Referring to FIGS. 2 to 3B, the antenna assembly 23 includes a ground metal layer 28, a dielectric medium 30, a first metal strip 32, and a second metal strip 34. The ground metal layer 28 is disposed on the grounding domain 24 in the base board 22 for grounding purposes. The dielectric medium 30 is a perspective structure, is mounted on the dielectric domain 26 in the base board 22, and has an upper surface 301 and four lateral surfaces 302, 303, 304, 305 extending downwardly from the upper surface 301. In this embodiment, the dielectric medium 30 is the atmosphere or any substance having a dielectric constant similar to the atmosphere. Alternatively, the dielectric medium 30 can be chosen from a group consisting of ceramic materials, FR-4 and FR-5 standard laminates, and PTFE (polytetrafluoroethylene), since all these substances have the dielectric constant similar to the atmosphere. The first metal strip 32 includes a wave-like strip section 322 that is mounted on the upper surface 301 of the dielectric medium 30 and that has the feed-in end 321 coupled electrically to a matching circuit (not shown) in the base board 22 for transmitting and receiving the wireless signals. The first metal strip 32 further includes a lateral strip section 323 that is mounted on the lateral surfaces 302, 303 of the dielectric medium 30 close to the upper surface 301 and has a first open end 324. The wave-like strip section 322 of the first metal strip 32 has a saw configuration when viewed from a lateral side thereof (see FIG. 3B). The lateral strip section 323 is connected to one end of the wave-like strip section 323, while the feed-in end 321 is connected to another end of the wave-like strip section 323. The second metal strip 34 is fabricated on the lateral surfaces 304, 305 of the dielectric medium 30 close to the upper surface 301, and has a coupling end 341 coupled electrically to the ground metal layer 28. By making an appropriate adjustment in the distance between the feed-in end 321 of the first metal strip 32 and the coupling end 341 of the second metal strip 34, the matching impedance ability of the antenna assembly 23 can be enhanced. Note that after assembly of the antenna assembly 23 in the mobile phone of the present invention, the first and second metal strips 32, 34 and the ground metal layer 28 cooperatively form an oscillator by virtue of electromagnetic induction to have a specific frequency range, thereby permitting transmitting and receiving wireless signals under multi frequencies within the specific frequency range.

The aforesaid antenna assembly 23 is generally used in the mobile phone of GSM (Global system for Mobile communication) and DCS (Digital Communication System) standards such that the handset can be operated within the ranges 880–960 MHz and 1710–1880 MHz. In this embodiment, the first and second metal strips 32, 34 has a dimension of $20\times10\times8$ mm$^2$, the ground metal layer 28 has a dimension of $40\times80$ mm$^2$, while the dielectric medium 30 has a thickness of 8 mm. The feed-in end 321 may have a length of 2 mm.

Figure 4:
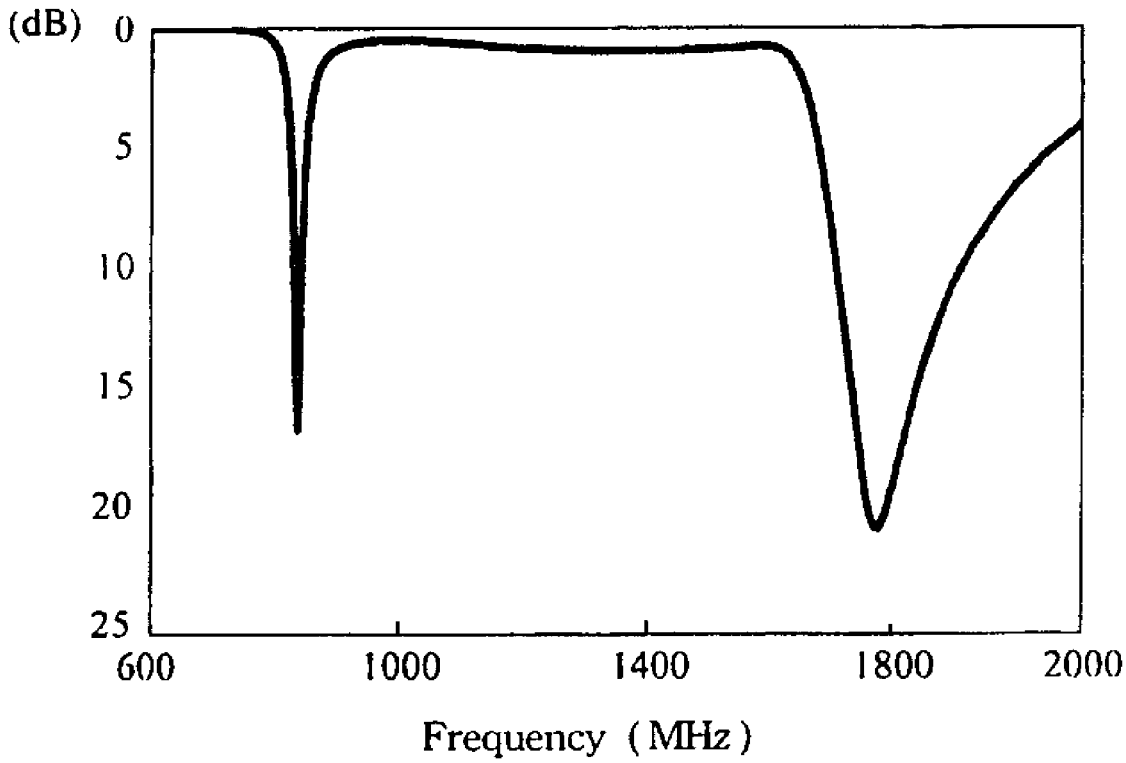
FIG. 4 illustrates a diagram for computer stimulation result of the antenna assembly according to the present invention under a specific dimension.
Figure 5A:
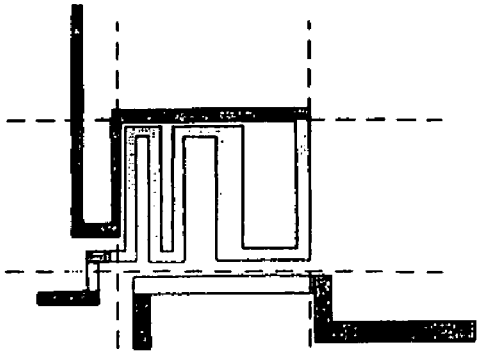
FIGS. 5A to 5F show spread-out views of different designs of the antenna assembly produced according to the present invention.
Figure 5B:
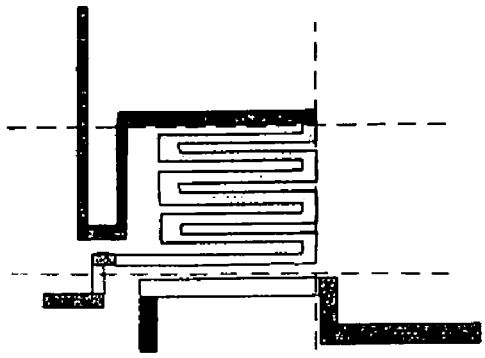
Figure 5C:
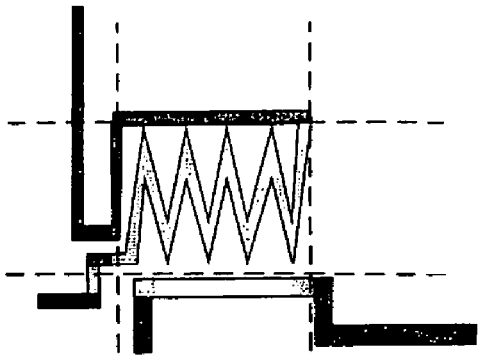
Figure 5D:
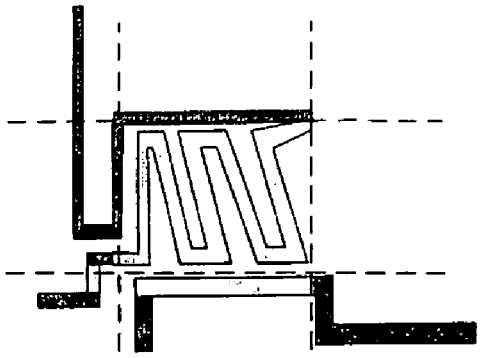
Figure 5E:
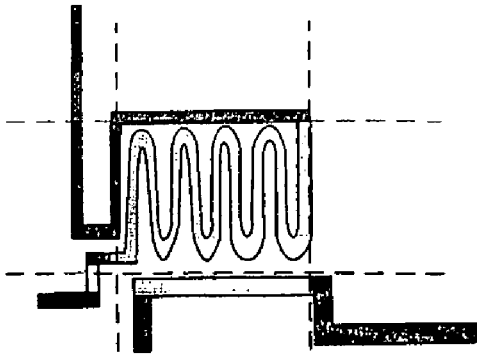
Figure 5F:
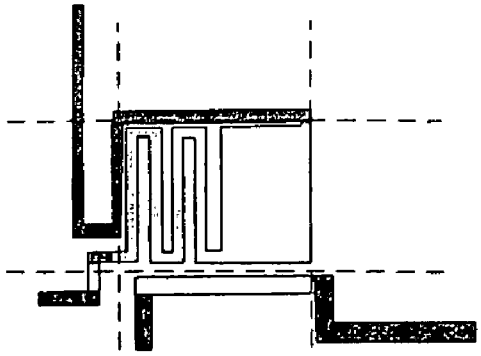

FIG. 4 is a diagram of the computer stimulation results, illustrating the input return loss verses frequency for the antenna assembly 23, wherein the latter has a low impedance of 25 Mhz bandwidth and a high impedance of 318 MHz bandwidth, which is, encompassed within the limited range of the GSM and DCS standards. In addition, the configuration of the wave-like strip section 322 of the first metal strip 32 (see FIG. 3B) should not be limited thereto, any other configurations can cover the scope of the present invention. FIGS. 5A to 5F respectively show spread-out view of different designs of the strip section 322, having zigzag configuration, ladder-shape configuration, and bellow-like configuration.

In summary, the antenna assembly employed in the mobile phone of the present invention provides the following advantages over the conventional techniques:

(1) The antenna assembly 23 is fabricated on the main board of the wireless telecommunication apparatus. It is a built-in type and therefore eliminates the assembly steps;

(2) The antenna assembly 23 is formed by bending the tiny metal strip into different configuration, thereby minimizing the size of the antenna assembly, which, in return, provides a larger space for mounting of the other components on the base board to increase the functionality of the handset equipped with the antenna assembly.

(3) By making a proper adjustment between the tiny metal strip and the ground metal layer, the impedance matching ability of the antenna assembly is enhanced, thereby lowering the difficulties encountered in the impedance matching operation.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An antenna assembly comprising:

a base board defining a grounding domain and a dielectric domain;

a ground metal layer fabricated on said grounding domain in said base board;

a dielectric medium, being a perspective structure, mounted on said dielectric domain in said base board, and having an upper surface and at least one lateral surface;

a first metal strip including a wave-like strip section mounted on said upper surface of said dielectric medium, a feed-in end, and a lateral strip section mounted on one of the at least one lateral surface of said dielectric medium, said lateral strip section having a first open end, the lateral strip section being connected to one end of the wave-like strip section, the feed-in end being connected to another end of the wave-like strip section; and a second metal strip fabricated on another one of the at least one lateral surface of said dielectric medium, said second metal strip having a coupling end coupled electrically to said ground metal layer, and a second open end; whereby, after assembly, said first and second metal strips and said ground metal layer cooperatively form an oscillator by virtue of electromagnetic induction to possess a specific frequency range, thereby permitting transmitting and receiving data signals under multi frequencies within said specific frequency range.

2. The antenna assembly according to claim 1, wherein said dielectric medium is atmosphere.

3. The antenna assembly according to claim 1, wherein said dielectric medium is chosen from a group consisting of ceramic materials, FR-4 and FR-5 standard laminates and PTFE (polytetrafluoroethylene).

4. The antenna assembly according to claim 1, wherein said second metal strip is adapted to adjust impedance matching of the antenna assembly.

5. The antenna assembly according to claim 1, wherein said base board has an upper surface defining said dielectric domain and a lower surface opposite to said upper surface and defining said grounding domain.

6. The antenna assembly according to claim 1, wherein said wave-like strip section of said first metal strip has a saw configuration when viewed from a lateral side thereof.

7. The antenna assembly according to claim 1, wherein said lateral strip section extends perpendicularly from said wave-like strip section of said first metal strip.

8. The antenna assembly according to claim 1, wherein said lateral strip section locates close to said upper surface.

9. The antenna assembly according to claim 1, wherein said second metal strip locates close to said upper surface.

10. A mobile phone comprising:

a base board defining a grounding domain and a dielectric domain;

a signal processing circuit fabricated on said base board for processing wireless signals; and an antenna assembly including a dielectric medium, being a perspective structure, mounted on said dielectric domain in said base board, and having an upper surface and at least one lateral surface, a first metal strip including a wave-like strip section mounted on said upper surface of said dielectric medium, a feed-in end coupled electrically to said signal processing circuit for transmitting and receiving said wireless signals, and a lateral strip section mounted on one of the at least one lateral surface of said dielectric medium, the lateral strip section being connected to one end of the wave-like strip section, the feed-in end being connected to another end of the wave-like strip section, and a second metal strip fabricated on another one of the at least one lateral surface of said dielectric medium, and having a coupling end coupled electrically to said ground metal layer, whereby, after assembly, said first and second metal strips and said ground metal layer cooperatively form an oscillator by virtue of electromagnetic induction to have a specific frequency range, thereby permitting transmitting and receiving wireless signals under multi frequencies within said specific frequency range.

11. The mobile phone according to claim 10, wherein said lateral strip section has a first open end.

12. The mobile phone according to claim 11, wherein said second metal strip further has a second open end.

13. The mobile phone according to claim 11, wherein said dielectric medium is atmosphere.

14. The mobile phone according to claim 11, wherein said dielectric medium is chosen from a group consisting of ceramic materials, FR-4 and FR-5 standard laminates and PTFE (polytetrafluoroethylene).

15. The mobile phone according to claim 11, wherein said second metal strip is adapted to adjust impedance matching of the antenna assembly.

16. The mobile phone according to claim 11, wherein said base board has an upper surface defining said dielectric domain and a lower surface opposite to said upper surface and defining said grounding domain.

17. The mobile phone according to claim 11, wherein said wave-like strip section of said first metal strip has a saw configuration when viewed from a lateral side thereof.

18. The mobile phone according to claim 11, wherein said lateral strip section extends perpendicularly from said wave-like strip section of said first metal strip.

19. The mobile phone according to claim 10, wherein said lateral strip section locates close to said upper surface.

20. The mobile phone according to claim 10, wherein said second metal strip locates close to said upper surface.

* * * * *